US006600394B1

(12) United States Patent
Wang et al.

(10) Patent No.: US 6,600,394 B1
(45) Date of Patent: Jul. 29, 2003

(54) TURNABLE, TEMPERATURE STABLE DIELECTRIC LOADED CAVITY RESONATOR AND FILTER

(75) Inventors: Chi Wang, Middletown, NJ (US); Gregory J. Lamont, Jackson, NJ (US); William D. Blair, Lanoka Harbor, NJ (US); William H. Holland, Pennington, NJ (US)

(73) Assignee: Radio Frequency Systems, Inc., Meriden, CT (US)

( * ) Notice: Subject to any disclaimer, the term of this patent is extended or adjusted under 35 U.S.C. 154(b) by 0 days.

(21) Appl. No.: 09/587,805

(22) Filed: Jun. 6, 2000

Related U.S. Application Data

(60) Provisional application No. 60/155,600, filed on Sep. 24, 1999.

(51) Int. Cl.[7] ..... H01P 7/00
(52) U.S. Cl. ..... 333/235; 333/231
(58) Field of Search ..... 333/235, 231, 333/232, 226

(56) References Cited

U.S. PATENT DOCUMENTS

| | | | | |
|---|---|---|---|---|
| 4,646,038 A | | 2/1987 | Wanat | 333/202 |
| 4,661,790 A | | 4/1987 | Gannon et al. | 333/234 |
| 4,728,913 A | | 3/1988 | Ishikawa et al. | 333/235 |
| 5,373,270 A | | 12/1994 | Blair | |
| 5,612,655 A | | 3/1997 | Stronks et al. | 333/202 |
| 5,712,605 A | | 1/1998 | Flory et al. | 333/219.1 |
| 5,712,606 A | | 1/1998 | Sarkka | 333/219.1 |
| 5,736,912 A | | 4/1998 | Mikami et al. | 333/235 |
| 5,793,268 A | * | 8/1998 | Ataiiyan et al. | 333/219.2 |
| 5,831,490 A | | 11/1998 | Sarkka | |
| 6,005,453 A | | 12/1999 | Sarkka | |
| 6,222,428 B1 | | 4/2001 | Akesson | |
| 6,255,922 B1 | * | 7/2001 | Malmstrom et al. | 333/219.1 |

OTHER PUBLICATIONS

Doug Jachowski et al.; Filters & Combiners For Communications Base Stations; IEEE MTT–S Symposium Workshop, San Diego, May 27, 1994; pp. 163.

* cited by examiner

*Primary Examiner*—Robert Pascal
*Assistant Examiner*—Joseph Chang
(74) *Attorney, Agent, or Firm*—Sughrue Mion, PLLC

(57) ABSTRACT

A tunable, temperature compensated, thermal and mechanical stable, dielectric loaded cavity resonator and filter assembly has high unloaded Q, wide frequency tuning range and simple structure suitable for high volume production. The cavity resonator consists of a conductive housing, a substantially cylindrical ring shape dielectric body with a low loss, low thermal expansion coefficient support, a tuning mechanism and a plastic support at the opposite side of the main cylindrical dielectric body, which holds the main cylindrical dielectric body in place. The tuning mechanism further includes a substantially cylindrical dielectric tuning element positioned in or near the hole of the main cylindrical dielectric body and a self-locked or equivalent nut locked rotor with a support using the same material as that of the main cylindrical body support. The rotor is accessible and rotational movable from the outside of the conductive enclosure, resulting in linear motion of the dielectric tuning element with respect to the main dielectric body. Therefore the resonant frequency of the resonator can be substantially adjusted.

10 Claims, 4 Drawing Sheets

TURNABLE, TEMPERATURE STABLE DIELECTRIC LOADED CAVITY RESONATOR AND FILTER

This application claims priority from Provisional Application No. 60/155,600 filed Sep. 24, 1999.

BACKGROUND OF THE INVENTION

The present invention generally relates to microwave dielectric loaded cavity resonators and filters, and in particular, to a tunable temperature stable dielectric loaded resonator and filter mechanism providing a wide range of resonant frequency adjustment and full range temperature stability for the dielectric loaded cavity resonators and filters.

Resonators are important components in microwave communication circuits. It is well known that dielectric loaded resonators exhibit superior performance characteristics over those of other known types of resonators. They offer high-unloaded Q in a small mechanical package. Thus, the dielectric loaded resonators are being used more frequently, particularly in narrow bandwidth, low insertion loss filters and multiplexers.

$TE_{01\delta}$ mode is usually the fundamental mode and the commonly used resonant mode for a dielectric loaded resonator. The resonant frequency of a dielectric resonator is primarily determined by the dimensions of the dielectric body when the relative dielectric constant of the material is larger than 30.

By bringing the enclosure close to the dielectric resonator, the resonant frequency of the $TE_{01\delta}$ mode is modified to a new increased value. Therefore, a typical method of changing the resonant frequency of a ceramic resonator 1 is to adjust the distance of a conductive metallic surface by a tuning plate 2 from a planar surface of the resonator housing 3, as shown in FIG. 1. However, the resonant frequency tuning range of the resonator that is changed by this method is very limited, and bringing the metal surface of the tuning mechanism close to dielectric resonator produces appreciable surface currents. As a result, the unloaded Q of the resonator is reduced.

For wider tuning range applications, a dielectric tuning plate 4 can be used to replace the metal plate 2 as shown in FIG. 2. In this case, as the dielectric tuning plate 4 is moved closer to the ceramic resonator 1, the resonant frequency decreases. The change in resonant frequency is nonlinear in relation to the change of the dielectric tuning plate 4. In addition, the resonant frequency is extremely sensitive when the dielectric tuning plate 4 is close to the main ceramic resonator body 1. Furthermore, it is very difficult to temperature compensate the resonator. A preferable way is to use a main dielectric ring resonator 5 and a smaller diameter dielectric tuning plug 6 positioned in or near the concentric main dielectric resonator hole 7, as shown in FIGS. 3 and 4. In this case, the resonant frequency change is nearly linear with respect to the dielectric plug movement.

For example, FIG. 5 shows changing frequency by movement of the ceramic plug 8. When the plug 8 is fully inserted into the resonator 9, frequency is at a minimum and with the plug 8 completely outside the resonator 9, frequency is at a maximum.

One skilled in the art will appreciate that it is usually difficult to position the dielectric body in the enclosure of the resonator. This is because the support structure must not influence the EM fields present in the resonator which can provide spurious responses. For example, FIGS. 3 and 4 show support mechanisms 11A and 11B for a resonator 5. FIG. 3 shows a lower resonator support 11A, and FIG. 4 shows a double resonator support 11B.

According to U.S. Pat. No. 5,612,655, to Stronks et al., a plastic supporting structure was used to support both the main dielectric body and the tuning element. However, this structure results in too many parts used in the assembly, and therefore the structure is very complicated. Furthermore, the structure cannot control unwanted lateral movement of the dielectric body, and the plastic material usually has a high thermal expansion coefficient, and therefore, the resonator lacks thermal and long term stability. In addition, as the thermal conductivity of the plastic is generally poor, it limits the average power handling of the resonator and filter.

High purity alumina can be used as support material to improve the thermal conductivity of the resonator from the main dielectric body to the resonator housing, because it has a low loss and a relative high thermal conductivity. However, as alumina is a very rigid ceramic material, it is very difficult to affix the dielectric body using alumina as the support in the resonator housing. As a result, such a resonator assembly is unreliable.

Furthermore, another problem with the tuning dielectric body of previous structures or methods is that they all must be assembled and installed prior to final resonator assembly. As a result, no replacement and repair of the tuning element is allowed after resonator assembly, which is not suitable for tunable resonators, filters, and mass production.

SUMMARY OF THE INVENTION

It is therefore an object of the invention to provide a dielectric resonator with a wide tuning range and temperature stable range while maintaining a high unloaded Q.

It is another object of the invention to provide a dielectric resonator that is simple and easy to manufacture in addition to being durable.

It is a further object of the invention to provide a dielectric resonator which can be repaired and tuned after resonator assembly.

According to an exemplary embodiment, a resonator assembly comprising a conductive cavity, a main dielectric body, a tuning element assembly and a plastic top support structure is provided.

A tunable, temperature compensated, thermally and mechanically stable dielectric loaded cavity resonator and filter assembly having high unloaded Q, a wide frequency tuning range and a simple structure suitable for high volume production is provided according to the present invention. The cavity resonator consists of a conductive housing, a substantially cylindrical ring-shaped dielectric body with a low loss, low thermal expansion coefficient support, a tuning mechanism and a plastic support at the opposite side of the main cylindrical dielectric body, that holds the main cylindrical dielectric body in place. The tuning mechanism further includes a substantially cylindrical dielectric tuning element positioned in or near the hole of the main cylindrical dielectric body and a self-locked or equivalent nut locked rotor with a support which is preferably made of the same material as that of the main dielectric cylindrical body support. The rotor is accessible and rotationally movable from the outside of the conductive enclosure, resulting in linear motion of the dielectric tuning element with respect to the main dielectric body. Therefore the resonant frequency of the resonator can be substantially adjusted.

BRIEF DESCRIPTION OF THE DRAWINGS

The foregoing and other features, objects, and advantages of the invention will be better understood by reading the following description in conjunction with the drawings, in which.

DETAILED DESCRIPTION OF THE PREFERRED EMBODIMENTS

Figure 1:
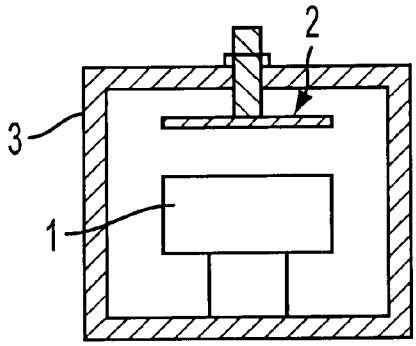
FIG. 1 (PRIOR ART)
FIG. 1 shows a tunable resonator with a metallic plate.
Figure 2:
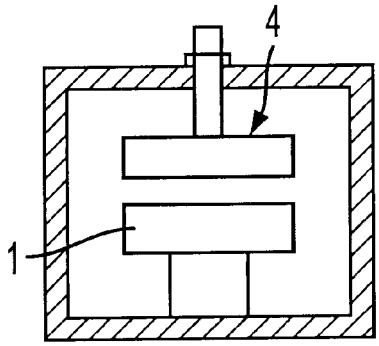
FIG. 2 (PRIOR ART)
FIG. 2 shows a tunable resonator with a ceramic plate.
Figure 3:
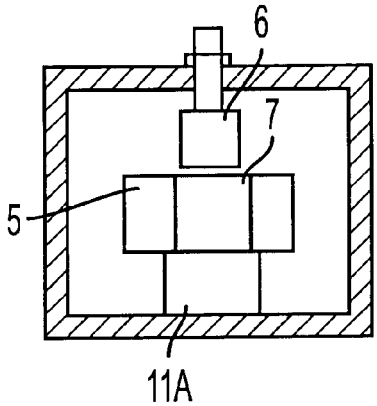
FIG. 3 (PRIOR ART)
FIG. 3 shows a resonator support structure.
Figure 4:
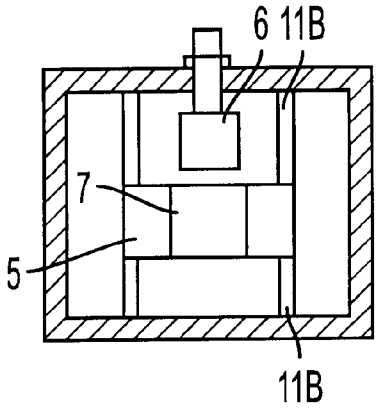
FIG. 4 (PRIOR ART)
FIG. 4 shows a resonator double support structure.
Figure 5:
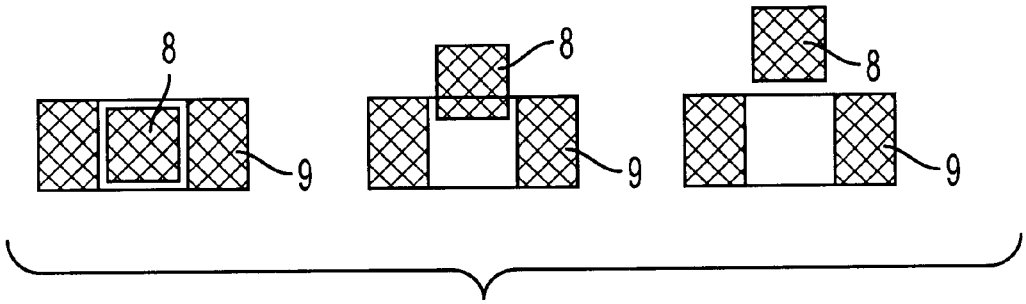
FIG. 5 (PRIOR ART)
FIG. 5 illustrates resonator tuning with a ceramic plug.

The various features of the invention will now be described with respect to the figures, in which like parts are identified with the same reference characters.

Figure 6:
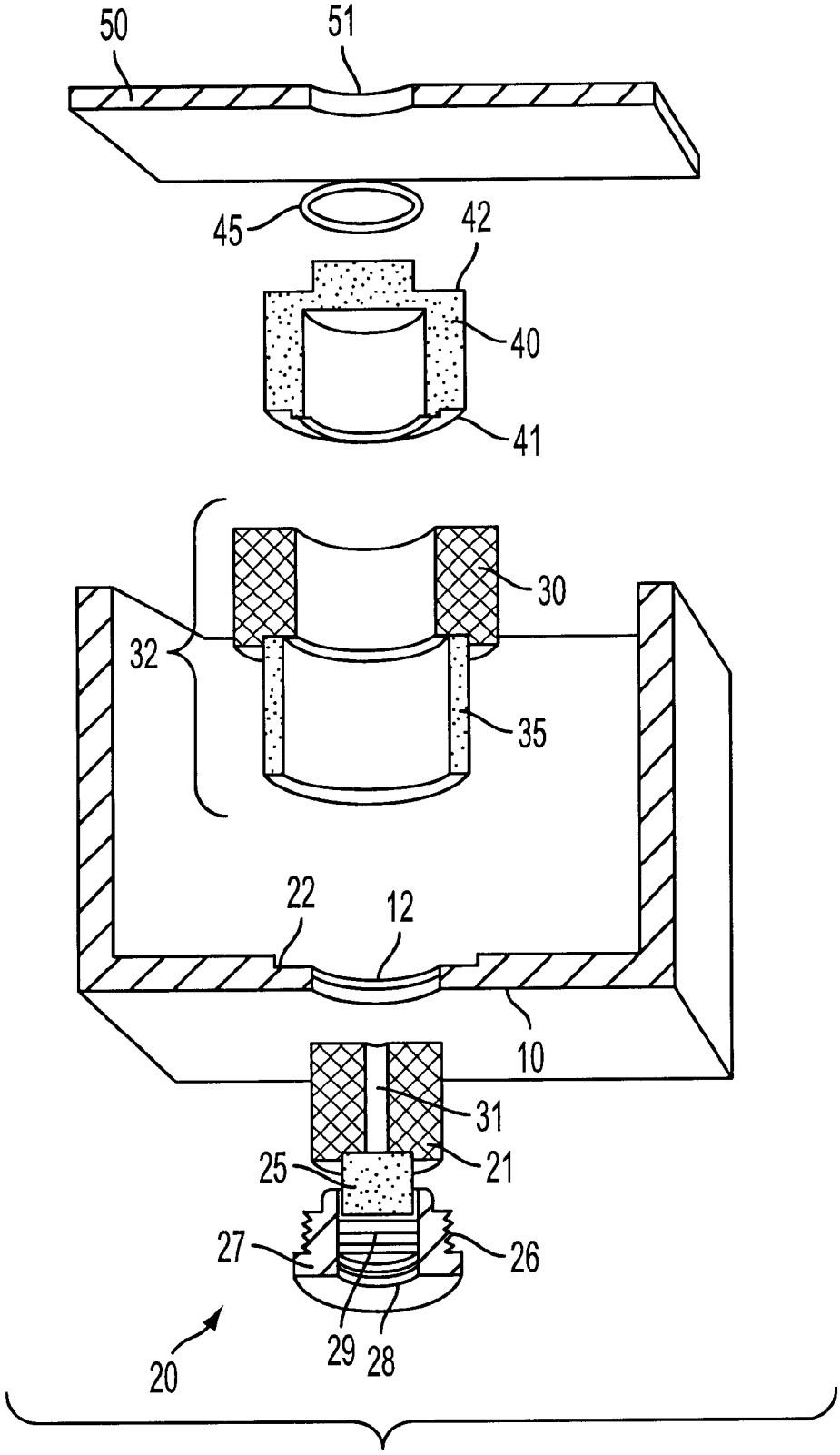
FIG. 6 shows a cutaway of an exemplary embodiment of the present invention.
Figure 7:
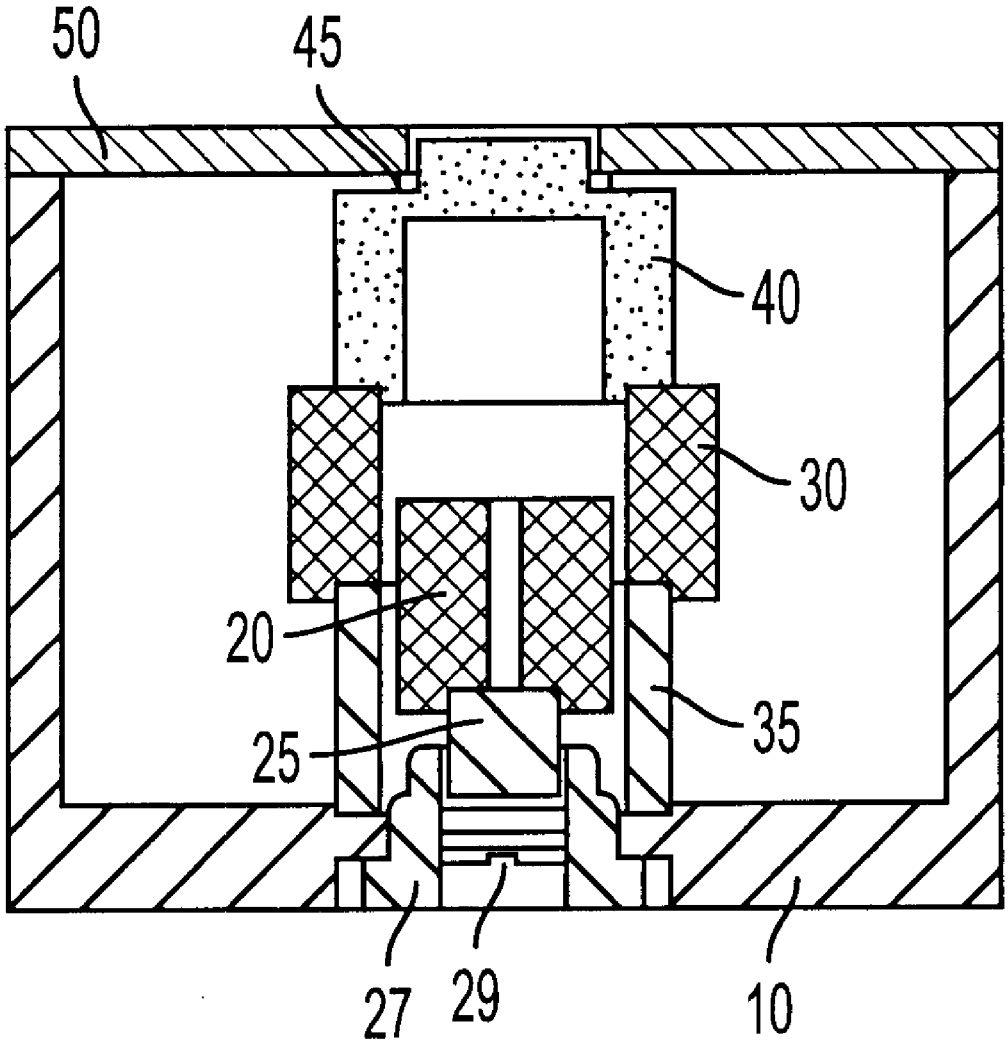
FIG. 7 shows an exemplary embodiment of a tunable resonator assembly of the present invention.

In accordance with one exemplary embodiment of the invention as shown in FIGS. 6 and 7, a resonator assembly includes a conductive housing 10 defining a cavity, a main dielectric body 32 disposed within the conductive housing 10, a tuning element assembly 20, and a plastic top support structure 40 adapted to support the main dielectric body 32. The main dielectric body 32 comprises a substantially cylindrical ring-shaped dielectric (ceramic) resonator 30 and a low loss, low thermal expansion coefficient support 35, preferably made of high purity alumina material, bonded together by low loss Epoxy or equivalent adhesive. The conductive housing 10 has a through hole 12 with threads at the center of the bottom wall to position the tuning element assembly 20 and a concentric counter bore 22 near the threaded through hole 12 to prevent the main dielectric body 30 and the support assembly 35 from lateral movement. A top conductive cover 50, which is part of the conductive housing 10, has a smaller hole 51 at the center of the top conductive cover 50 to affix the resonator top support 40 and prevent it from lateral movement.

The tuning element assembly 20 includes a bushing 27, a self-lock or nut-lock rotor 25 with a press-fit low loss, low thermal expansion coefficient support 31 and a smaller dielectric body as tuner 21 bonded together by low loss Epoxy or equivalent adhesive. The bushing 27 is preferably made from metal with outer threads 26 to affix the tuning element assembly 20 to the conductive housing 10 and fine inner threads 28 for tuning. A plastic top support 40 has steps 41 and 42 at both ends so that it can fit into the hole of the main dielectric resonator body 32 and the hole of the top conductive cover 50 to prevent the main dielectric resonator body 32 from both lateral and vertical movements.

In the resonator assembly, the bottom of the main dielectric body support 35 is set into the counter bore 22 in the bottom wall of the conductive housing 10, then the plastic top support 40 is positioned against the cylindrical ring-shaped dielectric resonator 30, opposite the support 35 of the main dielectric resonator body 32. To complete the assembly, a resilient O-ring 45, preferably formed from silicone rubber, is sandwiched between the last mentioned plastic top support 40 and the top conductive cover 50. The O-ring 45 under compression serves to absorb any tolerance build up and dimensional changes as the temperature varies, and allows the main resonator assembly (40 and 32) to be held firmly in position. The O-ring 45 also absorbs mechanical vibration and shock and makes the whole assembly rugged.

The tuning element assembly 20 can be installed into the conductive housing 10 either before or after the main dielectric resonator body 32 and plastic top support 40 are assembled. The small cylindrical dielectric body 21 of the tuning assembly 20 positioned in or near the hole in the main cylindrical dielectric resonator 30 is moved by means of an axial tuning mechanism which protrudes through, and/or is accessible for adjustment from, the outside of the conductive housing 10. The axial tuning mechanism comprises, e.g., an adjustment screw 29, nut-lock rotor 25 and inner threads 26 of the bushing 27. The smaller ceramic body 21 is connected to the adjustment screw 29 (via the support rod 31), which is accessible from the outside of the conductive housing 10. As the position of the smaller ceramic body 21 within the larger main cylindrical ceramic resonator 30 is adjusted, via the adjustment screw 29, the resonant frequency of the cavity is changed.

In accordance with another exemplary embodiment of the invention, both of the dielectric bodies are positioned from one side of the conductive enclosure with separate dielectric standoffs or supports 40 and 35 made from a low loss material such as alumina. To achieve temperature stability, it is preferable that each of these standoffs is made from same material with a small thermal expansion coefficient, for example alumina. In this way, as the ambient temperature varies, the positions of the main cylindrical ceramic resonator 30 and the ceramic tuner 21 are kept constant with respect to each other over the temperature range and whole tuning range. Because alumina has a relatively high thermal conductivity, another function of the main dielectric body support 35 is the transfer, from the main cylindrical dielectric body 30 to the conductive housing 10, of heat generated inside the main cylindrical dielectric body 30, so that average power handling of the dielectric resonators and filters can be improved.

In accordance with a further exemplary embodiment of the invention, the diameter of the threaded center hole 12 at the bottom of the conductive housing 10 is designed to be larger than that of the small tuning dielectric body 21, so that the tuning assembly 20 can be easily installed before or after the overall resonator is assembled. The tuning assembly 20 can also be replaced or repaired after the resonator and filter are assembled without opening the resonator and filter housing 10. The structure of the overall resonator assembly is therefore simple and durable. As a result, the present invention is suitable for volume production.

As an example of the invention for PCS 1900 MHz frequency band application, the resonator is preferably designed to have the enough tuning range to cover the whole frequency band, i.e. from 1930 MHz to 1990 MHz. One skilled in the art will appreciate that the specific dimensions of the housing 10, main resonator 30, and tuning element 21 may be selected in accordance with particular desired filter performance requirements. One skilled in the art will further appreciate that the techniques used for determining these dimensions and materials may be any of the procedures known in the art, for example as those disclosed in the cited publications. The main substantially cylindrical ceramic resonator 30, formed from a low-loss, high dielectric constant ceramic material, preferably having a dielectric constant between 29 and 45, has an opening extending completely through the main cylindrical ceramic resonator 30. The diameter of the opening for PCS frequency band is preferably between 0.60" and 0.70". The ceramic tuning element 21 is formed from low-loss material the same or different from the main cylindrical ceramic resonator 30. The diameter of the ceramic tuning element 21 is smaller than that of the opening of the main cylindrical ceramic resonator 30, preferably between 0.50" and 0.60" for 1900 MHz frequency range applications.

The ceramic support rod 31 is formed from low-loss, low dielectric constant and small thermal expansion coefficient material, preferably high purity alumina. The diameter of the support rod 31 is preferably smaller than that of the ceramic tuning element 21, and is strong enough to support the tuning element 21. The main dielectric body support 35 is preferably made of the same material as that of the ceramic tuner support 31. The inner diameter of the main dielectric body support 35 is preferably larger than both the diameter of the main cylindrical ceramic resonator 30 opening and the outer thread 26 diameter of the bushing 27 for affixing and adjusting the tuning element 21 in the cavity resonator. The outer diameter of the main dielectric body support 35 is preferably smaller than that of the outer diameter of the main cylindrical ceramic resonator 30. The height of the main dielectric body support 35 is preferably chosen so that the main cylindrical ceramic resonator 30 is set in the middle of the conductive housing 10 and has good spurious performance.

The outer diameter of the main ceramic resonator support 35 and the diameter of the counter bore 22 at the bottom of the conductive housing 22 are preferably kept in tight tolerance and fit well in order to hold the main cylindrical ceramic resonator 30 from lateral movement during vibration and temperature shifts. The lip 41 of the top plastic support 40 is also preferably formed to fit into the opening of the main cylindrical ceramic resonator 30 tightly, preventing the main cylindrical ceramic resonator 30 from lateral movement. The height of the plastic top support 40 is preferably chosen so that the resilient O-ring 45 sandwiched between the last mentioned plastic top support 40 and the top conductive cover 50 is compressed to absorb any tolerance build up and dimensional changes as the temperature varies in the assembly.

Figure 8A:
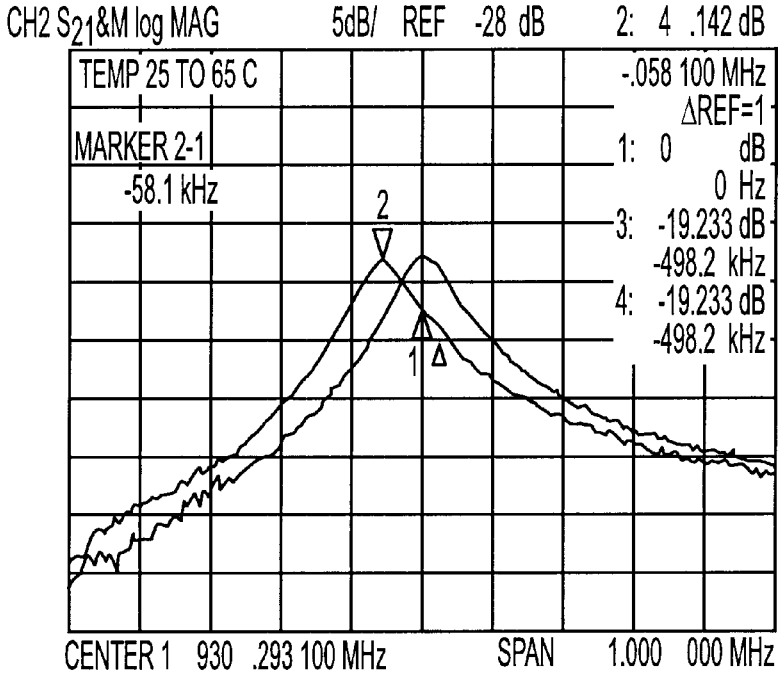
FIGS. 8A and B show a temperature vs. frequency shift curve for an exemplary embodiment according to the present invention.
Figure 8B:
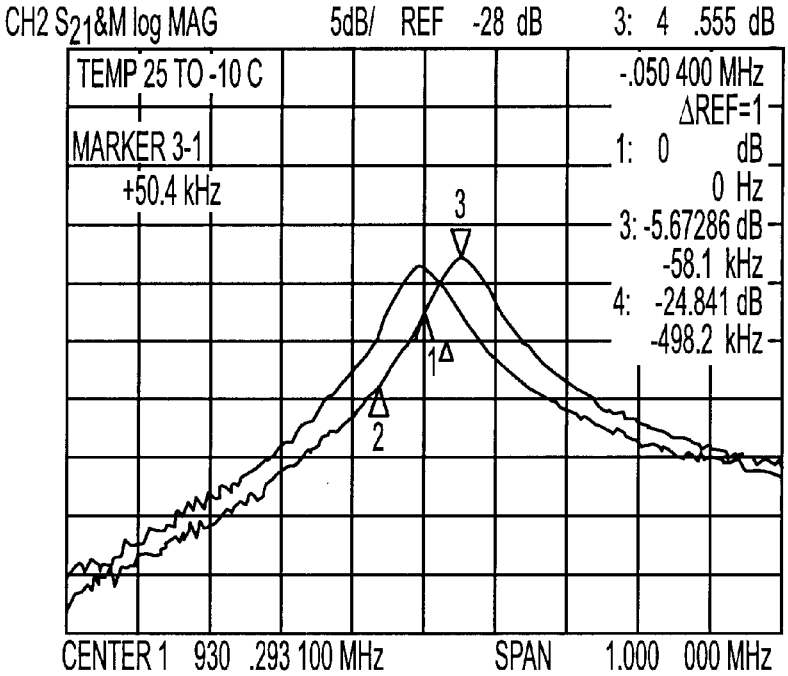

FIGS. 8A and 8B show frequency shift of the resonator as a function of temperature. FIG. 8A shows heating from room temperature to 65° C. and FIG. 8B shows cooling from room temperature to −10° C. One skilled in that art studying the figures will appreciate that in both heating and cooling of the resonator there is only a small shift in frequency which is highly desirable in resonators and filters.

The present invention has been described by way of example, and modifications and variations of the exemplary embodiments will suggest themselves to skilled artisans in this field without departing from the spirit of the invention. The preferred embodiments are merely illustrative and should not be considered restrictive in any way.

The scope of the invention is to be measured by the appended claims, rather than the preceding description, and all variations and equivalents that fall within the range of the claims are intended to be embraced therein.

What is claimed is:

1. A resonator assembly comprising:

a conductive housing defining a cavity;

a main dielectric body housed in the conductive housing;

a tuning element assembly removably connected to the bottom of the conductive housing; and a top support structure adapted to support the main dielectric body and positioned between a top conductive cover and the main dielectric body.

2. A resonator assembly comprising:

a conductive housing defining a cavity;

a main dielectric body housed in the conductive housing;

a tuning element assembly removably connected to the conductive housing;

a top support structure adapted to support the main dielectric body;

a bushing having outer threads adapted to affix the tuning element to the conductive housing, wherein the tuning element assembly is inserted at least partially into the conductive housing via a threaded through hole;

a dielectric tuner body adapted to movably fit within a hole of the main dielectric body, wherein the main dielectric body is a substantially ring-shaped dielectric resonator; and a rotor attached to the dielectric tuner body, wherein the rotor is accessible and rotationally movable from the outside of the conductive housing, resulting in linear motion of the dielectric tuner body with respect to the main dielectric body whereby a resonant frequency of the resonator can be substantially adjusted.

3. A resonator assembly comprising:

a conductive housing defining a cavity;

a main dielectric body housed in the conductive housing;

a tuning element assembly removably connected to the conductive housing;

a top support structure adapted to support the main dielectric body; and a lower support attached to the main dielectric body, wherein the lower support is set into a counter bore in the conductive housing, wherein the lower support is a low loss, low thermal expansion coefficient support.

4. The resonator assembly of claim 3, wherein at least one of the lower support and the top support structure is made of alumina.

5. A resonator assembly comprising:

a conductive housing defining a cavity;

a main dielectric body housed in the conductive housing;

a tuning element assembly removably connected to the conductive housing; and a top support structure adapted to support the main dielectric body;

wherein the top support structure has a top step and a bottom step, wherein the top step is adapted to fit into a hole in a top conductive cover of the conductive housing and the bottom step is adapted to fit in a hole of the main dielectric body, wherein the main dielectric body is a substantially ring-shaped dielectric resonator, and wherein the resonator assembly further comprises an o-ring positioned between the top conductive cover and the top support structure.

6. The resonator assembly according to claims 5, wherein the tuning element assembly includes a substantially cylindrical dielectric tuning element positioned in or near a hole of the main dielectric body; and a self-locked or equivalent nut locked rotor with a support using the same material as that of the main dielectric body support.

7. The resonator assembly of claim 6, wherein the rotor is accessible and rotationally movable from the outside of the conductive enclosure, resulting in linear motion of the dielectric tuning element with respect to the main dielectric body whereby the resonant frequency of the resonator can be substantially adjusted.

8. The resonator assembly of claim 5, wherein the tuning element assembly comprises:

a bushing having outer threads adapted to affix the tuning element assembly to the conductive housing, wherein the tuning element assembly is inserted at least partially into the conductive housing via a threaded through hole;

a dielectric tuner body adapted to movably fit within a hole of the main dielectric body, wherein the main dielectric body is a substantially ring-shaped dielectric resonator; and a rotor attached to the dielectric tuner body, wherein the rotor is accessible and rotationally movable from the outside of the conductive housing, resulting in linear motion of the dielectric tuner body with respect to the main dielectric body whereby a resonant frequency of the resonator can be substantially adjusted.

9. The resonator assembly of claim 8, further comprising:

a lower support attached to the main dielectric body, wherein the lower support is set into a counter bore in the conductive housing, wherein the lower support is a low loss, low thermal expansion coefficient support.

10. The resonator assembly of claim 9, wherein at least one of the lower support and the top support structure is made of alumina.

* * * * *